US009827795B2

(12) United States Patent
Hara et al.

(10) Patent No.: US 9,827,795 B2
(45) Date of Patent: Nov. 28, 2017

(54) PRINTING APPARATUS WITH CLEANING UNIT FOR CLEANING TRANSPORT BELT AND ROLLER

(71) Applicant: SEIKO EPSON CORPORATION, Tokyo (JP)

(72) Inventors: Koji Hara, Shiojiri (JP); Kazunori Mori, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/295,479

(22) Filed: Oct. 17, 2016

(65) Prior Publication Data

US 2017/0113476 A1 Apr. 27, 2017

(30) Foreign Application Priority Data

Oct. 22, 2015 (JP) ..... 2015-207761

(51) Int. Cl.
*B41J 29/17* (2006.01)

(52) U.S. Cl.
CPC ..... *B41J 29/17* (2013.01)

(58) Field of Classification Search
CPC ..... B41J 29/17
See application file for complete search history.

(56) References Cited

U.S. PATENT DOCUMENTS 9,120,380 B2 9/2015 Kobayashi

FOREIGN PATENT DOCUMENTS

| | | | |
|---|---|---|---|
| JP | 2004-161454 | * | 6/2004 |
| JP | 2004-161454 A | | 6/2004 |
| JP | 2015-066984 A | | 4/2015 |

* cited by examiner

*Primary Examiner* — Henok Legesse
(74) *Attorney, Agent, or Firm* — Workman Nydegger

(57) ABSTRACT

A printing apparatus includes a printing section that performs printing by discharging an ink onto a sheet of paper, a plurality of transport members that are respectively disposed in a plurality of locations in a transport pathway of the sheet of paper, and that are capable of transporting the sheet of paper along the transport pathway by rotating in contact with the sheet of paper, and a single cleaning unit that is used commonly during cleaning of the respective plurality of transport members.

8 Claims, 11 Drawing Sheets

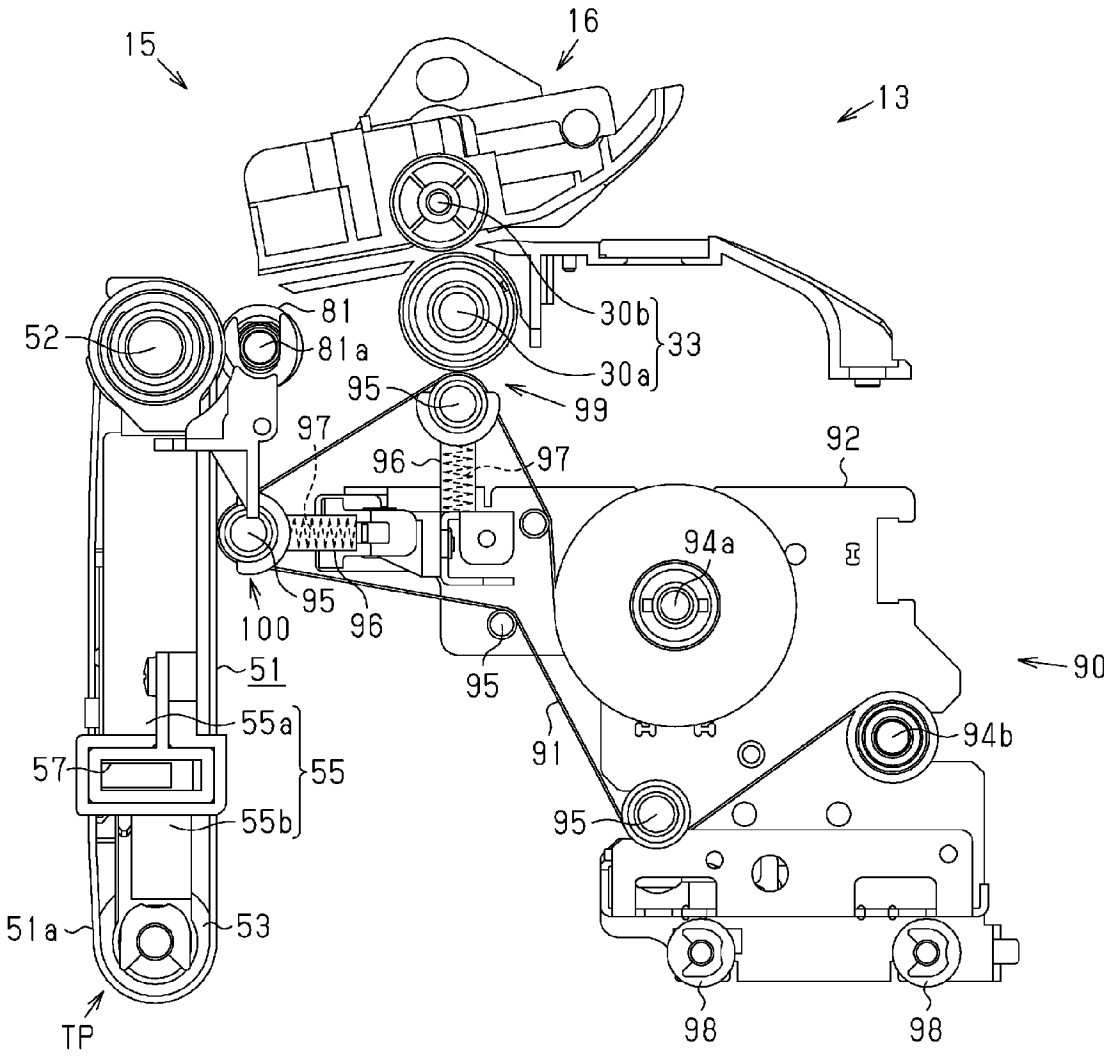
FIG. 11
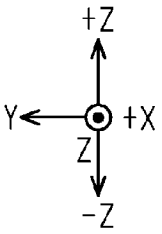

PRINTING APPARATUS WITH CLEANING UNIT FOR CLEANING TRANSPORT BELT AND ROLLER

BACKGROUND

1. Technical Field

The present invention relates to a printing apparatus that performs printing on a medium that is transported using a plurality of transport members.

2. Related Art

In the related art, an ink jet type printer that performs printing of an image or the like, on sheets of paper by transporting a sheet of paper, which is an example of a medium, up to a position of a printing section using a transport roller, and an endless form transport belt, which rotate while coming into contact with the sheet of paper, and discharging ink, which is an example of a liquid, toward the sheet of paper from a liquid discharging head, which the printing section is provided with is known as a type of printing apparatus.

In this kind of printer, when ink, which is discharged from the liquid discharging head, becomes attached to the outer surface of the transport belt, there is a concern that the ink will be transferred to sheets of paper that are transported by the transport belt, and that the sheets of paper will be stained. In such an instance, in a printer that is configured in this manner, a belt cleaner, which is capable of wiping away ink that is attached to the outer surface of the transport belt using cleaning webbing such as a non-woven fabric, is provided (for example, refer to JP-A-2004-161454).

Incidentally, in a printer of the related art, when ink, which is discharged onto a sheet of paper from the liquid discharging head, forms mist and becomes scattered, in addition to being attached to the outer surface of the transport belt, ink becomes attached to a circumferential surface of the transport roller, and both the transport belt and the transport roller, which are transport members that rotate in contact with a sheet of paper during the transport of sheets of paper, become stained. In such a case, when a roller cleaner (that is, a separate cleaning unit), which exclusively cleans the circumferential surface of the transport roller, is further installed separately from the belt cleaner, which is a dedicated cleaning unit of the transport belt, respective installation spaces are separately required, and the apparatus is increased in size.

SUMMARY

An advantage of some aspects of the invention is to provide a printing apparatus which is capable of cleaning a plurality of transport members that are used in the transport of a medium while suppressing an increase in size of the apparatus.

Hereinafter, means for solving the abovementioned technical problem and functional effects thereof will be described.

According to an aspect of the invention, there is provided a printing apparatus including a printing section that performs printing by discharging a liquid onto a medium, a plurality of transport members that are respectively disposed in a plurality of locations in a transport pathway of the medium, and that are capable of transporting the medium along the transport pathway by rotating in contact with the medium, and a single cleaning unit that is used commonly during cleaning of the respective plurality of transport members.

In this case, in a case in which the plurality of transport members that are disposed in the plurality of locations in the transport pathway, become stained by a liquid that is discharged from the printing section, the single cleaning unit is used commonly during cleaning of the respective transport members. Therefore, it is not necessary to separately provide a dedicated cleaning unit for each transport member. Accordingly, it is possible to perform cleaning of a plurality of transport members that are used in the transport of the medium while suppressing an increase in the size of the apparatus.

In the printing apparatus, it is preferable that the plurality of transport members include a roller member that is capable of transporting the medium by rotating causing a circumferential surface to come into contact with the medium, and an endless form belt member that is disposed in a different position to that of the roller member, and that is capable of transporting the medium by rotating in a circuit form causing a belt surface to come into contact with the medium.

In this case, in a configuration that performs printing by discharging a liquid from the printing section onto a medium that is transported by the plurality of transport members, which include the roller member and the belt member, in a case in which the circumferential surface of the roller member and the belt surface of the belt member are stained, the single cleaning unit is used commonly during cleaning of the roller member and during cleaning of the belt member. Therefore, since it is not necessary to separately provide a dedicated cleaning unit for the roller member and a dedicated cleaning unit for the belt member, it is possible to perform cleaning of the roller member and cleaning of the belt member while suppressing an increase in the size of the apparatus.

In the printing apparatus, it is preferable that the cleaning unit includes a first cleaning section that is capable of cleaning one transport member, and a second cleaning section that is capable of cleaning another transport member in a position that differs from that of the first cleaning section.

In this case, in a case in which the first cleaning section, which is used in the cleaning of the one transport member, is stained, since it is still possible to clean the other transport member with the second cleaning section, which is included in a different position to that of the first cleaning section, it is possible to suppress a concern that the staining, which is removed from the one transport member, will be transferred during cleaning of the other transport member.

In the printing apparatus, it is preferable that the cleaning unit includes a band-shaped member that is stretched between a plurality of wind-around portions, and, in the band-shaped member, a portion that is wound around one wind-around portion in a length direction configures the first cleaning section, and a portion that is wound around another wind-around portion configures the second cleaning section.

In this case, as long as the band-shaped member is stretched between the plurality of wind-around portions, since the first cleaning section and the second cleaning section are formed in separate positions in the length direction of the band-shaped member, it is possible to easily configure a cleaning unit that can be used commonly in the cleaning of the plurality of transport members.

In the printing apparatus, in a state in which the band-shaped member is wound around the wind-around portions, it is preferable that portions that are wound around the wind-around portions in the length direction are capable of moving in a direction of being shifted in position from the corresponding wind-around portions.

In this case, in a case in which the first cleaning section and the second cleaning section become stained by the cleaning of each transport member, as long as the band-shaped member is moved, it is possible to substitute the first cleaning section and the second cleaning section in the length direction of the band-shaped member with portions that are not yet stained.

In the printing apparatus, in a state in which the band-shaped member is wound around the one wind-around portion, it is preferable that a portion that configures the first cleaning section is capable of moving in a direction of approaching the other one wind-around portion, around which a portion that configures the second cleaning section is wound.

In this case, in a case in which the extent of the staining of the transport member that is cleaned by the second cleaning section is higher than the extent of the staining of the transport member that is cleaned by the first cleaning section, it is possible to reuse the first cleaning section, which is used in the cleaning of the transport member for which the extent of the staining is low, as the second cleaning section, which cleans the transport member for which the extent of the staining is high.

In the printing apparatus, it is preferable that, in the band-shaped member, while a portion in the length direction that configures the first cleaning section is used in the cleaning of a transport member that is furthest from the printing section in a relative manner among the plurality of transport members, a portion in the length direction that configures the second cleaning section is used in the cleaning of a transport member that is closest to the printing section in a relative manner among the plurality of transport members.

Normally, in a transport member that is disposed in a position that is close to a printing section and a transport member that is disposed in a position that is far from the printing section, the extent of the staining due to the attachment of a liquid that is discharged from the printing section is relatively less for the transport member that is disposed in a position that is far from the printing section than for the transport member that is disposed in a position that is close to the printing section.

In this case, for this reason, it is possible to reuse the first cleaning section, which is used in the cleaning of the transport member for which the extent of the staining is relatively low, as the second cleaning section during cleaning of the transport member for which the extent of the staining is relatively high.

In the printing apparatus, it is preferable that the cleaning unit can be displaced between a first position at which cleaning of the one transport member is possible as a result of the first cleaning section of the band-shaped member coming into contact with the one transport member, and a second position at which cleaning of the other transport member is possible as a result of the second cleaning section of the band-shaped member coming into contact with the other transport member.

In this case, it is possible to switch between a state in which the first cleaning section cleans the one transport member, and a state in which the second cleaning section cleans the other transport member as a result of the cleaning unit being displaced between the first position and the second position.

In the printing apparatus, it is preferable that the wind-around portions extend along a direction that is parallel to an axis of rotation of the transport members, and have a configuration in which a biasing force, which biases the wind-around portions toward the transport members, is applied to both end portions and an intermediate portion in the length direction of the wind-around portions.

In this case, a circumstance such as an intermediate portion in the length direction of the wind-around portions becoming warped into a state of not coming into contact with the transport members due to a force that is applied to both ends of the wind-around portions, is avoided due to the biasing force that is also applied to the intermediate portion, and therefore, it is possible to clean by causing the band-shaped member, which is wound around the wind-around portions, to suitably come into contact with the transport members.

In the printing apparatus, it is preferable that, among the plurality of transport members, a transport member that is cleaned by the second cleaning section is a belt member, a belt surface of which rotates in a circuit form, the belt surface coming into contact with the medium in a position that faces the printing section, and a transport member that is cleaned by the first cleaning section is a roller member, a circumferential surface of which rotates, the circumferential surface coming into contact with the medium in a position that is either further on an upstream side or a downstream side than the belt member in the transport pathway of the medium.

In this case, while it is possible to clean the roller member with the first cleaning section, it is also possible to clean the belt member with the second cleaning section.

BRIEF DESCRIPTION OF THE DRAWINGS

The invention will be described with reference to the accompanying drawings, wherein like numbers reference like elements.

FIG. 11 is a side view that shows another modification example of the cleaning unit.

DESCRIPTION OF EXEMPLARY EMBODIMENTS

Hereinafter, an ink jet type printer, which is provided with a printing section that discharges an ink, which is an example of a liquid, and which prints images that include characters, graphics, and the like, by discharging the ink onto sheets of paper, which are an example of a medium, will be described as an embodiment of a printing apparatus with respect to the drawings.

Figure 1:
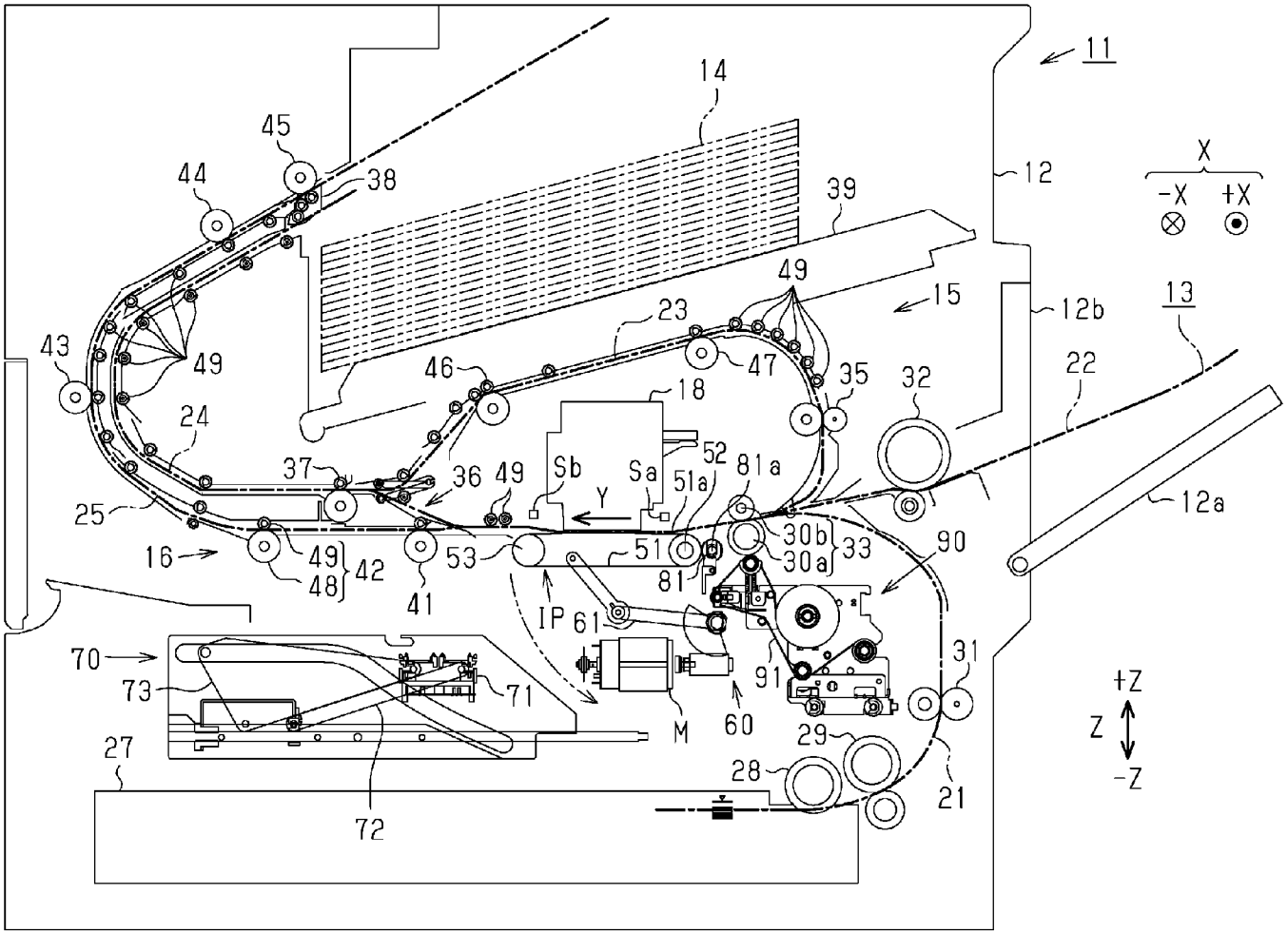
FIG. 1 is a side view that shows an overall structure of an embodiment of a printer, which is an example of a printing apparatus, in a schematic manner.

As shown in FIG. 1, a printer 11, as an example of a printing apparatus of the present embodiment, includes a housing 12 represented as a substantially rectangular parallelepiped that is formed from a plurality of exterior cases, as an apparatus main body, and inside the housing 12, is provided with a transport pathway 13 that transports sheets of paper 14 in the manner that is shown by the thick dashed-dotted line in FIG. 1. Further, a transport member 15 that is capable of transporting the sheets of paper 14 along the transport pathway 13 by coming into contact with the sheets of paper 14, and a printing section 18 that discharges an ink onto the sheets of paper 14, which are transported by the transport member 15, are installed in the housing 12. The transport member 15 is configured to include a plurality of roller members 16, which are disposed inside the housing 12 in a plurality of locations in the transport pathway 13, and which transport the sheets of paper 14 by rotating, and a transport belt (a belt member) 51 that transports and supports the sheets of paper 14 from a −Z side (a lower side) in a gravity direction of a vertical direction Z. The roller member 16 is configured by various rollers that are respectively disposed in the transport pathway 13, and for example, a supply driving roller 30*a*, a supply driven roller 30*b*, a transport driving roller 48, a toothed roller 49, and the like, which will be described later, are types of the roller member 16. The transport belt 51 is installed in the housing 12 in a state of being capable of moving to a first position, which faces the printing section 18 with the transport pathway 13 interposed therebetween, using a belt movement section 60 that is, a usable state.

In the present embodiment, the printing section 18 is configured by a so-called line head that includes a liquid discharging head in which a width direction X that intersects (is orthogonal to in this instance) a transport direction Y of the sheets of paper 14, is set as a longitudinal direction, and which is capable of simultaneously discharging an ink throughout the entirety of the longitudinal direction. Additionally, in order to simplify the description from this point onwards, in the width direction X, a left direction when viewed from an upstream side in the transport direction Y (a direction of following a front surface side of a paper surface) will be referred to as a +X direction, and a right direction when viewed from the upstream side in the transport direction Y (a direction of following a rear surface side of a paper surface) will be referred to as a −X direction.

The printing section 18, which is configured as a line head, performs printing by discharging the ink from the +Z side (an upper side) in an antigravity direction toward the sheets of paper 14 that are transported in a state of being supported by the transport belt 51. Additionally, a position of the transport belt 51 when printing is being performed on the sheets of paper 14 by the printing section 18, that is, a first position, in which the transport belt 51 faces the printing section 18, will be referred to as a printing position IP.

The transport pathway 13 is configured by a first supply pathway 21 and a second supply pathway 22, which are further on the upstream side in the transport direction Y than the printing section 18, and a third supply pathway 23, a branched pathway 24, and an ejection pathway 25, which are further on a downstream side in the transport direction Y than the printing section 18. The first supply pathway 21 is a pathway that links a paper sheet cassette 27, which is provided in an insertable and removable manner in a bottom portion of the housing 12, which corresponds to the −Z side in the gravity direction, and the printing section 18. Further, a pick-up roller 28, which feeds out a topmost sheet of paper 14 among sheets of paper 14 that are mounted in the paper sheet cassette 27 in a layered state, and an isolation roller 29, which isolates sheets of paper 14 fed out by the pick-up roller 28 one sheet at a time, are provided in the first supply pathway 21. Furthermore, a first pair of supply rollers 31, which clamp and transport a sheet of paper 14 fed out from the paper sheet cassette 27, are provided further on the downstream side in the transport direction Y than the isolation roller 29. Additionally, the pick-up roller 28 and the isolation roller 29 are also types of the roller member 16.

The second supply pathway 22 is a pathway that links an insertion section 12*b*, which is exposed as a result of opening a cover 12*a* that is provided on one side surface of the housing 12, and the printing section 18. Further, a second pair of supply rollers 32, which clamp and transport sheets of paper 14 that are inserted from the insertion section 12*b*, are provided in the second supply pathway 22. Furthermore, a third pair of supply rollers 33 are provided in a position at which the first supply pathway 21, the second supply pathway 22 and the third supply pathway 23 converge, and a fifth pair of supply rollers 35 are provided in the third supply pathway 23. Further, the first pair of supply rollers 31 to the third pair of supply rollers 33 and the fifth pair of supply rollers 35 are respectively configured by a columnar supply driving roller 30*a*, which rotates on the basis of a driving force of a driving source, which is not illustrated in the drawings, and a supply driven roller 30*b*, which rotates in accordance with the rotation of the supply driving roller 30*a*.

The third supply pathway 23 is a pathway that is provided in a manner that surrounds the printing section 18, and is a pathway for returning a sheet of paper 14 that has passed through the printing section 18 once to further on the upstream side than the printing section 18 again. That is, a branching mechanism 36 is provided further on the downstream side than the printing section 18, and a branching pair of rollers 37, in which rotation in both directions of normal rotation and reverse rotation is possible, are provided in the branched pathway 24 which branches off from the ejection pathway 25. Additionally, the branching pair of rollers 37 are also types of the roller member 16.

The ejection pathway 25 is a pathway that links an ejection port 38, through which sheets of paper 14 on which printing is complete, are ejected, and the printing section 18. Additionally, the sheets of paper 14 that are discharged from the ejection port 38 are mounted on a mounting platform 39. Further, at least one pair of transport rollers (a first pair of transport rollers 41 to a fifth pair of transport rollers 45 in the present embodiment) is provided in the ejection pathway 25. Furthermore, a sixth pair of transport rollers 46 and a seventh pair of transport rollers 47 are also provided in the third supply pathway 23. The first pair of transport rollers 41 to the seventh pair of transport rollers 47 clamp and transport sheets of paper 14 to which ink is attached. In addition, the third pair of supply rollers 33 and the fifth pair of supply rollers 35 also clamp and transport sheets of paper 14 to which ink is attached.

That is, the first pair of transport rollers 41 to the seventh pair of transport rollers 47 are respectively configured by a columnar transport driving roller 48 that rotates on the basis of a driving force of a driving source, and a toothed roller 49 that rotates in accordance with the rotation of the transport driving roller 48. In addition, the toothed rollers 49 are also provided independently in the transport pathway 13 in a manner that does not form a pair with a transport driving roller 48. That is, in the third supply pathway 23, the branched pathway 24 and the ejection pathway 25, the toothed rollers 49 are provided on a side that a printing surface (that is, a surface on which ink, which is an example of a liquid, is discharged and attached), which is a surface on which printing of the sheets of paper 14 is carried out, passes through. In addition, the toothed rollers 49 are provided between the first pair of transport rollers 41 to the seventh pair of transport rollers 47 in the transport direction Y, and are provided between each pair of transport rollers and the printing section 18. On the other hand, the transport driving rollers 48 are provided on a side that a non-printing surface, on which printing is not performed, of the sheets of paper 14, or a surface which is printed on first in a sheet of paper 14 on which duplex printing is being performed, passes through.

In the present embodiment, the transport belt 51, which is in the printing position IP that faces the printing section 18, has a configuration that transports the sheets of paper 14 by traveling in a circuit in a state of supporting a sheet of paper 14 on a belt surface 51*a*, which is an outer circumferential surface thereof, due to electrostatic adsorption. That is, the transport belt 51 is an endless form belt that is stretched between two rollers, one roller of the two rollers is set as a driving roller 52, which is driven in a rotational manner by a driving source, and the other roller is set as a driven roller 53, which rotates in accordance with the circuits of the belt. In addition, a charging roller 81 is configured so that a rubber layer is formed on the outer surface of a roller shaft 81*a*, which is made from metal, and high pressure is applied as a result of causing a plate spring, which is not illustrated in the drawings, to come into direct contact with an end portion of the roller shaft 81*a*. Alternatively, the charging roller 81 may also be configured so that a shaft bearing portion, which bears the roller shaft 81*a* of the charging roller 81, is set as a conductive bearing (a conductive resin, a sintered bearing, or the like), and high pressure is applied through the conductive bearing. Further, the transport belt 51 travel in a circuit in accordance with the rotation of the driving roller 52, and the transport belt 51 is charged with static electricity due to the charging roller 81, which comes into contact with the belt surface 51*a* during the circuits. The transport belt 51 adsorbs the sheets of paper 14 to the belt surface 51*a*, which is formed between the driving roller 52 and the driven roller 53 and which is flat on the +Z side in the antigravity direction, due to the charged static electricity, and transports an adsorbed sheet of paper 14 in the transport direction Y while causing the sheet of paper 14 to face the printing section 18. In this instance, the transport belt 51, in which the belt surface 51*a* is caused to travel in a circuit as a result of the rotation of the driving roller 52, can also be interpreted as rotating in circuit form with an intermediate portion in the transport direction Y between the driving roller 52 and the driven roller 53 as the center thereof. That is, it can be said that the transport member 15, which includes the roller member 16 and the transport belt 51 transports the sheets of paper 14 along the transport pathway 13 as a result of rotating in contact with the sheets of paper 14.

In addition, in the present embodiment, a first sensor Sa, which detects the sheets of paper 14 on the upstream side in the transport direction Y, and a second sensor Sb, which detects the sheets of paper 14 on the downstream side in the transport direction Y, are installed in the printing section 18. The first sensor Sa and the second sensor Sb are sensors (for example, optical type sensors) that are in an "ON" state that outputs a predetermined signal when a sheet of paper 14 is detected, and in a case in which a sheet of paper 14 is transported by the transport belt 51 without being delayed, the second sensor Sb turns "ON" once a predetermined amount of time has elapsed after the first sensor Sa turns "ON".

Meanwhile, in the present embodiment, a belt movement section 60 using which the transport belt 51 is moved from the printing position IP, in which printing is performed by the printing section 18, to a second position that is further separated from the printing section 18 than the printing position IP, is provided in the printer 11. That is, the belt movement section 60 includes a link member 61, which acts in accordance with rotational driving of a motor M, as a driving source.

The link member 61 is driven in accordance with driving of the motor M, and as shown by the dashed-two dotted line arrow in FIG. 1, causes the transport belt 51 to move to the second position, which is further separated from the printing section 18 than the printing position IP by causing the driven roller 53 side to swing with the driving roller 52 as the center thereof from the printing position IP, which is the first position, toward the −Z side in the gravity direction.

Figure 2:
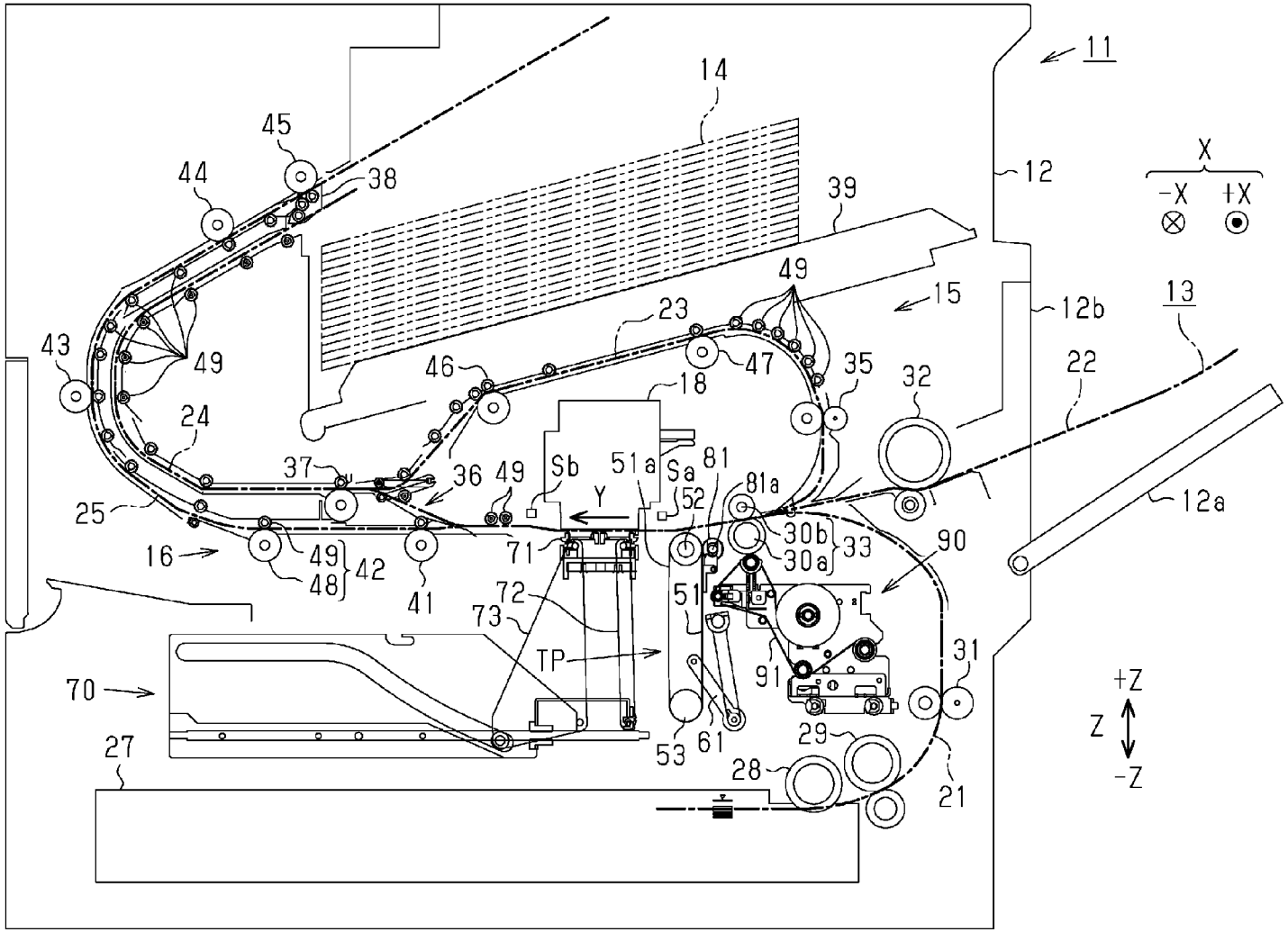
FIG. 2 is a side view that shows a state in which a transport belt is moved to a retreat position from the state in FIG. 1, and a cap comes into contact with a printing section.

As shown in FIG. 2, in the present embodiment, a position at which the transport belt 51 is rotated (swung) by approximately 90 degrees from the printing position IP with the driving roller 52 as the center thereof, is set as the second position, and the second position is referred to as a retreat position TP. Further, in the present embodiment, the belt surface 51*a* of the transport belt 51 has a horizontal posture, which corresponds to a substantially horizontal plane in the printing position IP, and has a vertical posture, which corresponds to a substantially vertical plane that follows the vertical direction Z in the retreat position TP.

Incidentally, a state in which the transport belt 51 is in the retreat position TP is a state in which printing on the sheets of paper 14 cannot be performed by the printing section 18. In such an instance, in order to retain the printing performance (for example, the character printing quality) of the printing section 18 by suppressing drying of the ink inside the printing section 18, for example, as shown in FIG. 2, a cap movement mechanism 70, which covers the printing section 18 by coming into contact with a cap 71 from the −Z side in the gravity direction with respect to the printing section 18 in a state in which printing cannot be performed, is provided in the printer 11.

The cap movement mechanism 70 has a configuration in which a member 72 and a member 73, which maintain the cap 71 in a manner in which it is possible to cover at least a portion of the printing section 18 that discharges the ink with an enclosed space, causes the cap 71 to move (move up and down) along the vertical direction Z using a link mechanism, a cam mechanism, and the like, when reciprocating along the transport direction Y. Further, as shown in FIG. 1, in a state of being separated from the printing section 18 in which the printing section 18 is not covered, the members that configure the cap 71 and the cap movement mechanism 70 (for example, the member 72 and the member 73) are installed in positions that do not come into contact with the transport belt 51, which moves (swings) between the printing position IP and the retreat position TP as shown by the dashed-two dotted line arrow in the drawing. In other words, a printer 11 in which the transport belt 51 does not come into contact with the cap 71 and the cap movement mechanism 70 in a state in which the printing section 18 is not covered, during movement between the printing position IP and the retreat position TP, is provided.

In addition, as shown in FIGS. 1 and 2, in the present embodiment, in the printer 11, a single cleaning unit 90, which includes a cleaning member 91 that removes staining of the transport belt 51 and the supply driving roller 30*a*, which configures the third pair of supply rollers 33, is provided.

That is, the cleaning unit 90, a portion of the cleaning member 91 of which is in contact with the circumferential surface of the supply driving roller 30*a*, is configured to be capable of reciprocating along the transport direction Y in accordance with rotational driving of a motor, as a driving source, which is not illustrated in the drawings. Further, as a result of movement of the cleaning member 91 in the transport direction Y, staining such as ink that is attached to the belt surface 51*a* is cleaned by wiping away thereof due to coming into contact with the belt surface 51*a* of the transport belt 51. The cleaning unit 90 will be described later with reference to FIG. 5.

Next, the configuration of the belt movement section 60 will be described.

Figure 3:
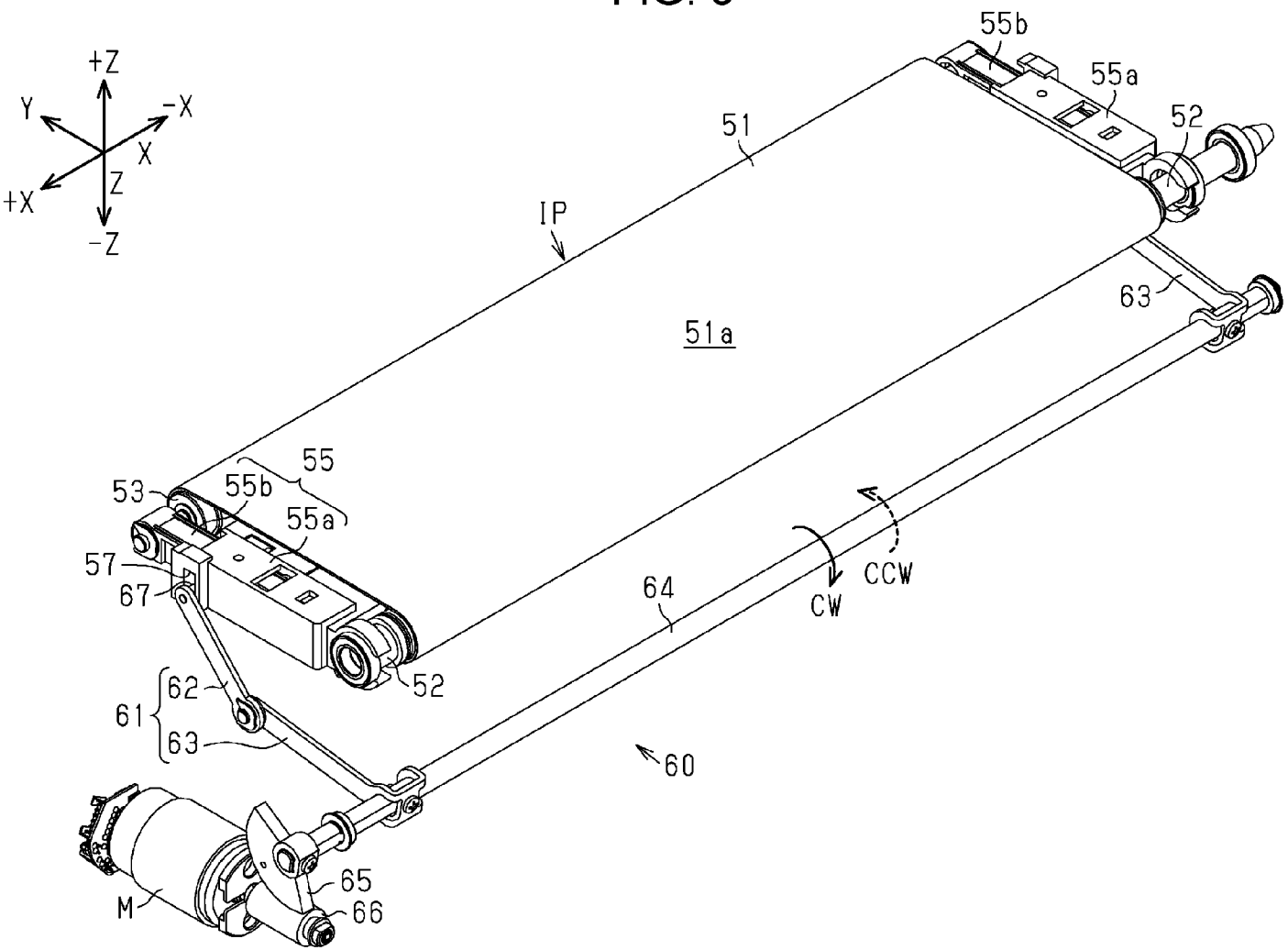
FIG. 3 is a perspective view that shows a belt movement section in which the transport belt is moved to a printing position.

As shown in FIG. 3, in the same manner as the printing section 18, the transport belt 51 has a longitudinal direction along the width direction X. Further, the belt movement section 60 is connected to both end portions of the transport belt 51 in the width direction X. The belt movement section 60 moves the transport belt 51 between the printing position IP and the retreat position TP. That is, a rotational shaft 64, to which one end of a worm gear 65 is fixed, rotates in accordance with rotation of the worm gear 65 that meshes together with a worm 66, which is fixed to a motor shaft of a motor M with which the belt movement section 60 is provided. One end of first link plates 63 are respectively fixed to and attached to the rotational shaft 64 in two locations that are separated in the longitudinal direction (the width direction X) of the rotational shaft 64, and one end of second link plates 62 are attached to the other end of the first link plates 63 in a freely rotatable manner. The first link plates 63 and the second link plates 62 that are attached in this manner configure the link member 61.

In the driving roller 52 and the driven roller 53, which cause the transport belt 51 to travel in a circuit, the respective roller shaft ends are axially supported by belt frame bodies 55 in a rotatable manner in both side end portions in the belt width direction (the X direction in this instance) of the transport belt 51. In the belt frame bodies 55, portions that support the roller shaft ends of the driven roller 53 in a rotatable manner are set as extendable portions 55*b*, which expand and contract in directions that link an axial center of the driving roller 52 and an axial center of the driven roller 53 to base body portions 55*a* when portions that support the roller shaft ends of the driving roller 52 in a rotatable manner are set as the base body portions 55*a*. Further, in the present embodiment, the extendable portions 55*b* are biased toward a direction of protruding from the base body portions 55*a* by biasing members, which are provided in the belt frame bodies 55 but are not illustrated in the drawings. As a result of this, the driven roller 53, which is supported by the extendable portions 55*b* is biased so that a distance from the driving roller 52 is long, and is configured so that a predetermined tension is applied to the transport belt 51, which hangs across the driving roller 52 and the driven roller 53. In this manner, the transport belt 51 is stretched between the driving roller 52 and the driven roller 53.

In addition, recessed portions 57, which are configured as substantially rectangular grooves, are formed in the belt frame bodies 55 in the base body portions 55*a*. Meanwhile, substantially columnar pins 67 are attached to the other ends of the second link plates 62, and the pins 67 are set to a state of penetrating into and engaging with the recessed portions 57 of the belt frame bodies 55. Accordingly, as shown by the solid line arrow CW in FIG. 3, the rotational shaft 64 rotates in a clockwise direction when viewed from the +X direction side as a result of driving of the motor M, and the pins 67, which are attached to the second link plates 62 cause the belt frame bodies 55 to move (swing) as a result of the first link plates 63 and the second link plates 62 moving in accordance with the rotation of the rotational shaft 64. In this manner, the belt movement section 60 moves the transport belt 51 to the printing position IP as a result of moving the belt frame bodies 55. In addition, as shown by the dashed line arrow CCW in FIG. 3, the rotational shaft 64 rotates in an anticlockwise direction when viewed from the +X direction as a result of driving of the motor M, and the pins 67, which are attached to the second link plates 62 cause the belt frame bodies 55 to move as a result of the first link plates 63 and the second link plates 62 moving in accordance with the rotation of the rotational shaft 64.

Figure 4:
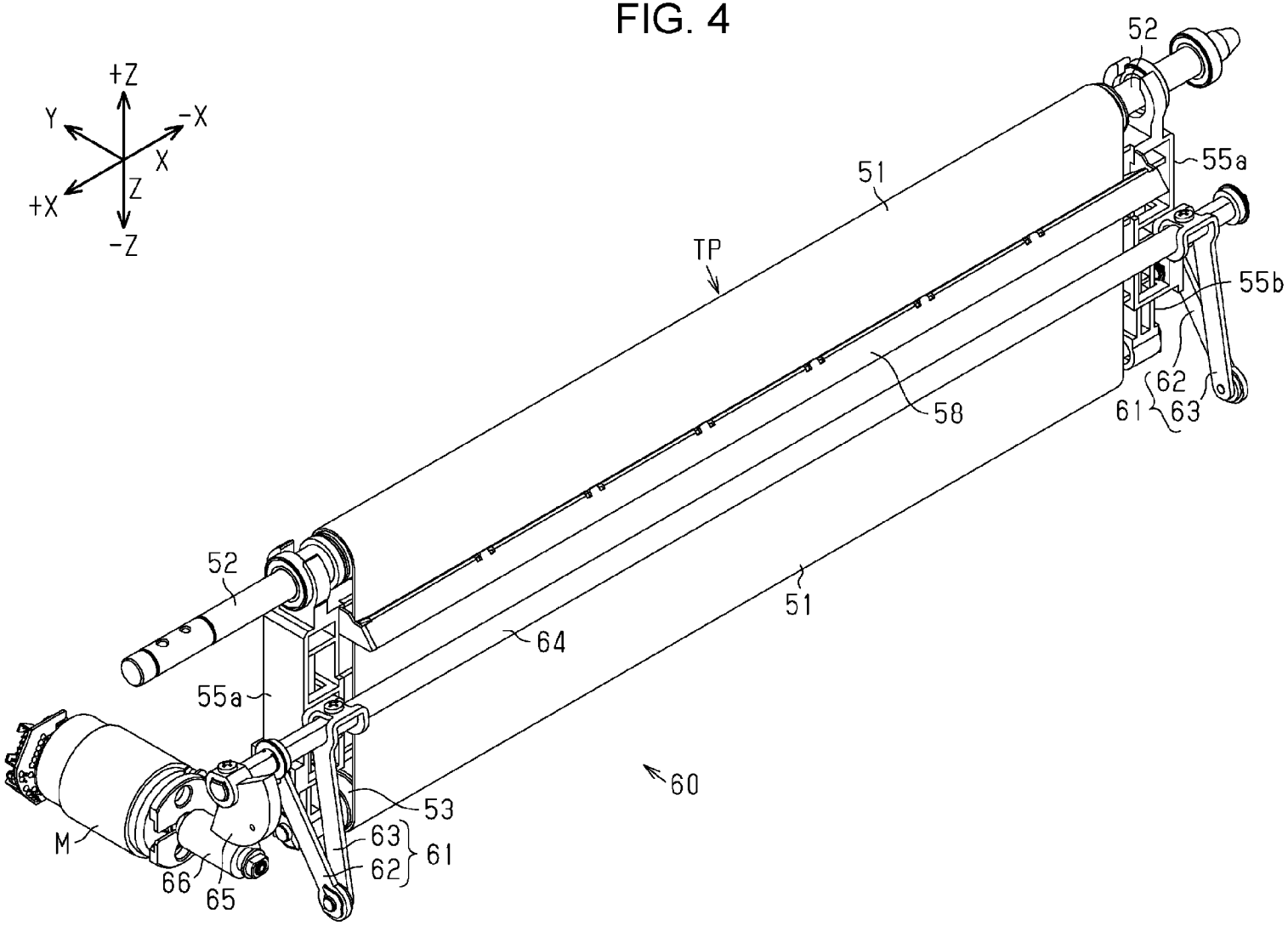
FIG. 4 is a perspective view that shows the belt movement section in which the transport belt is moved to the retreat position.

As shown in FIG. 4, the transport belt 51 moves (swings) to the same retreat position TP as the state that is shown in FIG. 2 as a result of the movement of the belt frame bodies 55 by the belt movement section 60. In the present embodiment, the rotation of the motor M is converted to rotation of the worm gear 65, which meshes together with the worm 66 that is attached to the rotational shaft (the motor shaft) of the motor M. Accordingly, the rotational shaft 64, to which the worm gear 65 is attached, rotates at a rotational angle that is smaller than the rate of rotation of the motor M (the rate of rotation of the worm 66). In other words, it is possible to cause the rotational shaft 64 to rotate with a rotational angle having high accuracy as a result of the rotation of the motor M. In addition, since the rotational direction of the worm gear 65 is in a direction that intersects the rotational direction of the worm 66, the rotational angle to which the rotational shaft 64 is rotated is retained in a state in which rotation of the motor M is stopped. As a result of this, the position of the belt surface 51*a* of the transport belt 51, which is set to a substantially horizontal plane in the printing position IP, is determined with high positional accuracy, and the position of the belt surface 51*a* of the transport belt 51, which is set to a substantially vertical plane in the retreat position TP, is determined with high positional accuracy.

Additionally, in the present embodiment, a configuration in which a state in which the position of the transport belt 51 is determined as the printing position IP is detected by controlling the rotational amount of the motor M, is set. Meanwhile, a configuration in which a state in which the position of the transport belt 51 is determined as the retreat position TP is detected by a detection sensor, which is not illustrated in the drawings, is set. Naturally, a configuration in which a detection sensor that detects a state in which the position of the transport belt 51 is determined as the printing position IP, is provided, and a state in which the position of the transport belt 51 is determined as the printing position IP is detected by the detection sensor, may also be used. In addition, in the present embodiment, the transport belt 51 is provided so as to be capable of rotating in a circuit form in a state of being positioned in the retreat position TP in addition to a state of being positioned in the printing position IP.

As shown in FIG. 4, a paper debris collection blade 58, which takes away paper debris that is attached to the transport belt 51, is provided on the belt frame bodies 55. In the paper debris collection blade 58, an extended portion, which extends along the width direction X is provided in a manner that bridges the gap between the base body portions 55*a* of the belt frame bodies 55, which are positioned at both ends of the transport belt 51 in the width direction X. The extending portion has a configuration that takes away paper debris from the belt surface 51*a* by scraping away paper debris, which is attached to the belt surface 51*a*, from the belt surface 51*a*, adsorbing the paper debris, or the like, by coming into contact with the belt surface 51*a*.

Next, the cleaning unit 90 will be described.

Figure 5:
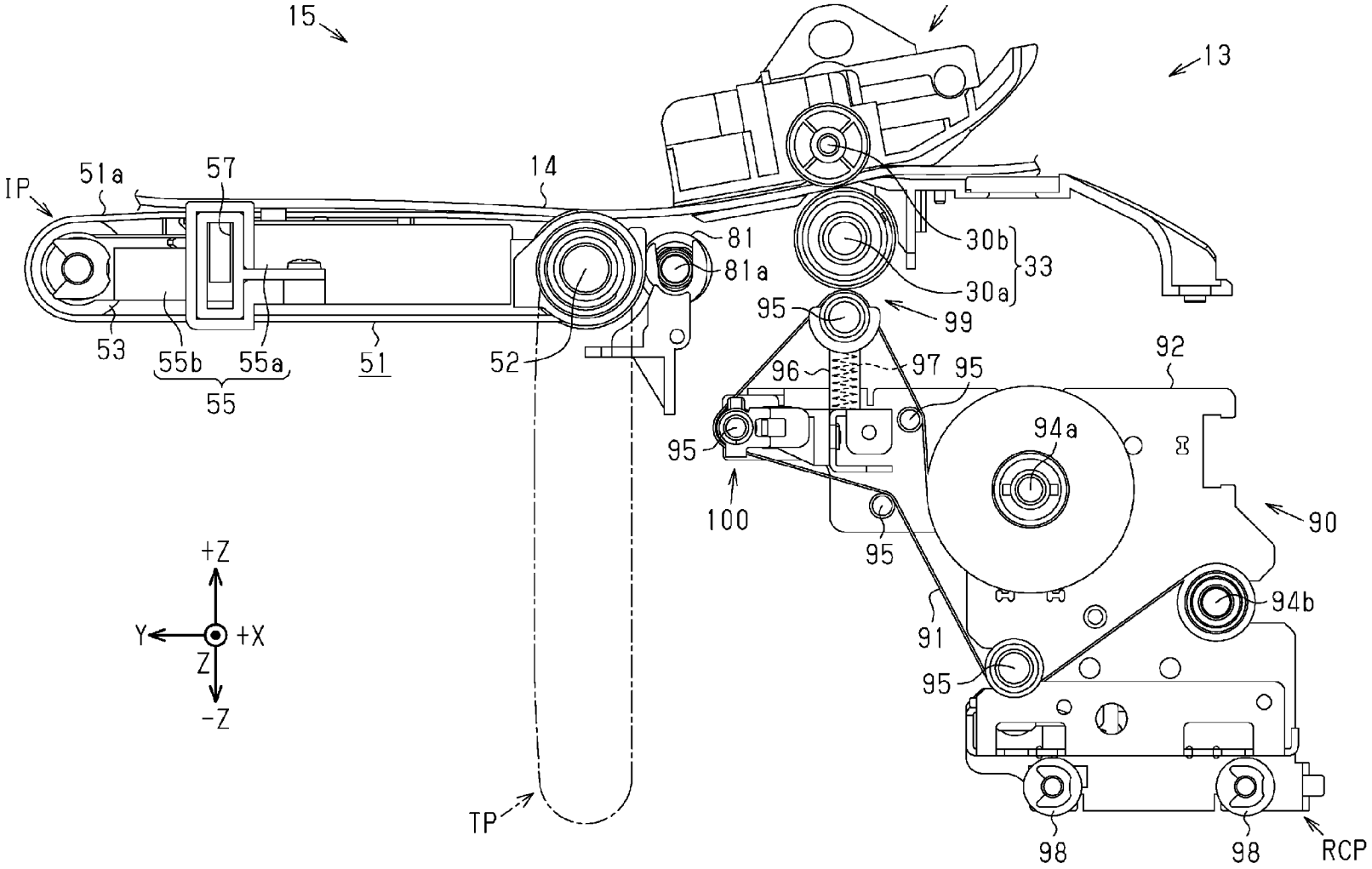
FIG. 5 is a side view that shows a cleaning unit in a case in which the transport belt is positioned in the printing position.

As shown in FIG. 5, the cleaning unit 90, which includes the cleaning member 91 for wiping away and removing (cleaning) staining that is attached to the circumferential surface of the supply driving roller 30*a*, which configures the third pair of supply rollers 33, and the belt surface 51*a* of the transport belt 51, is provided in the printer 11 of the present embodiment (refer to FIGS. 1 and 2).

The cleaning member 91, which is formed from a band-shaped member such as a woven fabric (webbing), is attached to a base frame 92, which the cleaning unit 90 is provided with, in a state of being wound around cylindrical shaft-shaped roll cores in roll form. In the present embodiment, the cleaning unit 90 includes a wind-out side roll core 94*a*, and a wind-up side roll core 94*b* of the cleaning member 91, and both end portions of the respective roll cores 94*a* and 94*b* are attached to the base frame 92 in a freely rotatable manner. Further, the cleaning member 91, which is wound onto the wind-out side roll core 94*a*, has substantially the same length in the axial direction (the width direction X) of the roll core 94*a* as the length of the transport belt 51 in the width direction X, and is wound up to the wind-up side roll core 94*b*. In the present embodiment, the wind-out side roll core 94*a* is positioned above, which corresponds to the +Z side in the antigravity direction, the wind-up side roll core 94*b*. Incidentally, the cleaning member 91 in FIG. 5 is illustrated in a substantial wind-out initiation state.

In addition, the cleaning unit 90 is provided with a motive power transmission mechanism, which is attached to the base frame 92 but is not illustrated in the drawings. For example, the motive power transmission mechanism is configured by a plurality of gears, and rotational driving of a motor, as a driving source, which is not illustrated in the drawings, is transmitted to the wind-up side roll core 94*b* by the motive power transmission mechanism, and causes the roll core 94*b* to rotate. The cleaning member 91, which is wound around the wind-out side roll core 94*a* is wound out as a result of the rotation of the wind-up side roll core 94*b*, and is wound up onto the wind-up side roll core 94*b* as a result of moving in a state of being stretched between a plurality (five in the present embodiment) of wind-around portions 95, which are attached to the base frame 92 in a freely rotatable manner. That is, the cleaning member 91 is a longitudinal member in which a direction that intersects the width direction X corresponds to the length direction, and is provided in a manner in which it is capable of moving in the length direction.

In this instance, among the wind-around portions 95 that are provided in a plurality in the cleaning unit 90, a single wind-around portion 95 that is positioned uppermost in the vertical direction Z is supported in a position that faces the supply driving roller 30*a* by the base frame 92 through a pair of extended portions 96, both end portions in the width direction X of which extend upward from the base frame 92. In addition, each extended portion 96 respectively includes a spring 97 in an inner portion thereof, and the springs 97 bias the wind-around portion 95, which is provided at the tip ends of the extended portions 96, toward the supply driving roller 30*a*. That is, in the cleaning member 91, a portion that is wound around the wind-around portion 95, which is provided at the tip ends of the extended portions 96, is in contact with the circumferential surface of the supply driving roller 30*a*. In other words, in the cleaning member 91, a portion that is wound around the wind-around portion 95, which is provided at the tip ends of the extended portions 96, functions as a roller cleaning section (a first cleaning section) 99, which cleans the supply driving roller 30*a*. Additionally, for convenience of description, the wind-around portion 95 around which the cleaning member 91, which functions as the roller cleaning section 99, is wound, will be collectively referred to as a first wind-around portion 95.

In addition, among the wind-around portions 95 that are provided in a plurality in the cleaning unit 90, a single wind-around portion 95 that is positioned furthest on the downstream side (furthest on the left side in FIG. 5) in the transport direction Y, is disposed so as to face the transport belt 51, which is positioned in the retreat position TP. Additionally, for convenience of description, this wind-around portion 95 will be referred to as a second wind-around portion 95.

In this instance, the cleaning unit 90 is set to be capable of moving in a sliding manner along the transport direction Y as a result of rollers 98, which are attached to a lower end portion of the base frame 92 in a rotatable manner, rolling along a guide rail, which is not illustrated in the drawings. That is, the cleaning unit 90 has a configuration that reciprocates (moves in a sliding manner) along the transport direction Y due to the rollers 98 being caused to rotate as a result of the base frame 92 being pushed and pulled along the transport direction Y by a driving source (for example, an actuator), which is not illustrated in the drawings, for example. The cleaning member 91 moves in a sliding manner along the transport direction Y in accordance with the movement of the cleaning unit 90. Therefore, in the present embodiment, the rollers 98 function as a portion of a cleaning member movement section that moves the cleaning unit 90.

The cleaning member movement section positions the cleaning member 91, which is wound around the second wind-around portion 95, in a separated position, which is separated from the transport belt 51, which is positioned in the retreat position TP, by moving the cleaning unit 90 to the upstream side in the transport direction Y. In the cleaning unit 90, which is positioned in the separated position, the cleaning member 91, which is wound around the first wind-around portion 95 is in contact with the circumferential surface of the supply driving roller 30*a*. That is, the separated position corresponds to a roller cleaning position (a first position) RCP at which the roller cleaning section 99 of the cleaning unit 90 performs cleaning of the supply driving roller 30*a*.

In addition, the cleaning member movement section positions the cleaning member 91, which is wound around the second wind-around portion 95, in a contact position, which comes into contact with the belt surface 51*a* of the transport belt 51, by moving the cleaning unit 90 to the downstream side in the transport direction Y. That is, the cleaning member 91, which is wound around the second wind-around portion 95, functions as a belt cleaning section (a second cleaning section) 100 that cleans the transport belt 51. In addition, the contact position corresponds to a belt cleaning position (a second position) BCP at which the belt cleaning section 100 of the cleaning unit 90 performs cleaning of the transport belt 51 (refer to FIG. 8). Accordingly, the cleaning unit 90 is provided so as to be capable of moving between the roller cleaning position RCP and the belt cleaning position BCP using the cleaning member movement section.

Next, the actions of the present embodiment will be described.

In the present embodiment, an operation process that cleans the transport belt 51 in a case in which it is assumed that the transport belt 51 is stained, is performed as the action of the present embodiment. In addition, in a case in which printing by the printing section 18 is not being performed, and the like, an operation process that regulates the tension of the transport belt 51 is performed.

Additionally, these operation processes are configured by a central computation processing device (a CPU), a storage device (a memory), and the like, and are performed as a result of a control section of the printer 11, which controls printing processes such as a process that discharges the ink in the printing section 18, carrying out driving control of each driving source, and the like, in a predetermined order.

As shown in FIG. 5, in a case in which the printer 11 performs printing on a sheet of paper 14, the transport belt 51 is positioned in the printing position IP. At this time, the cleaning unit 90 is positioned in the roller cleaning position RCP, and the roller cleaning section 99 is in contact with the circumferential surface of the supply driving roller 30*a*, which configures the third pair of supply rollers 33. Further, the supply driving roller 30*a* is rotated in order to transport the sheet of paper 14 along the transport direction Y using the third pair of supply rollers 33. That is, in a state in which the transport belt 51 is positioned in the printing position IP, the cleaning unit 90 cleans the supply driving roller 30*a* as a result of the supply driving roller 30*a* rotating after the roller cleaning section 99 comes into contact with the supply driving roller 30*a*. Additionally, in the present embodiment, since the third pair of supply rollers 33 are positioned in the vicinity of the printing section 18 in comparison with the other roller members 16, the third pair of supply rollers 33 have a configuration in which staining is easier than the other roller members 16 due to the mist of ink that the printing section 18 discharges.

In this instance, when the control section of the printer 11 assumes that the transport belt 51 is stained as a result of a printing operation of the printing section 18, the cleaning unit 90 performs a cleaning operation of the transport belt 51. Additionally, the cleaning operation is performed on the basis of detection results of the first sensor Sa and the second sensor Sb, which are respectively provided further on the upstream side and the downstream side than the printing section 18 in the transport direction Y. More specifically, in a case in which the second sensor Sb does not turn "ON" within a predetermined amount of time after the first sensor Sa turns "ON", the control section assumes that the transport belt 51 is stained. The reason for this that, in a case in which the second sensor Sb does not turn "ON" within a predetermined amount of time, the control section assumes that the transport of the sheets of paper 14 on the transport belt 51 is delayed, and that ink that is discharged from the printing section 18 is attached to the transport belt 51 rather than the sheets of paper 14.

Figure 6:
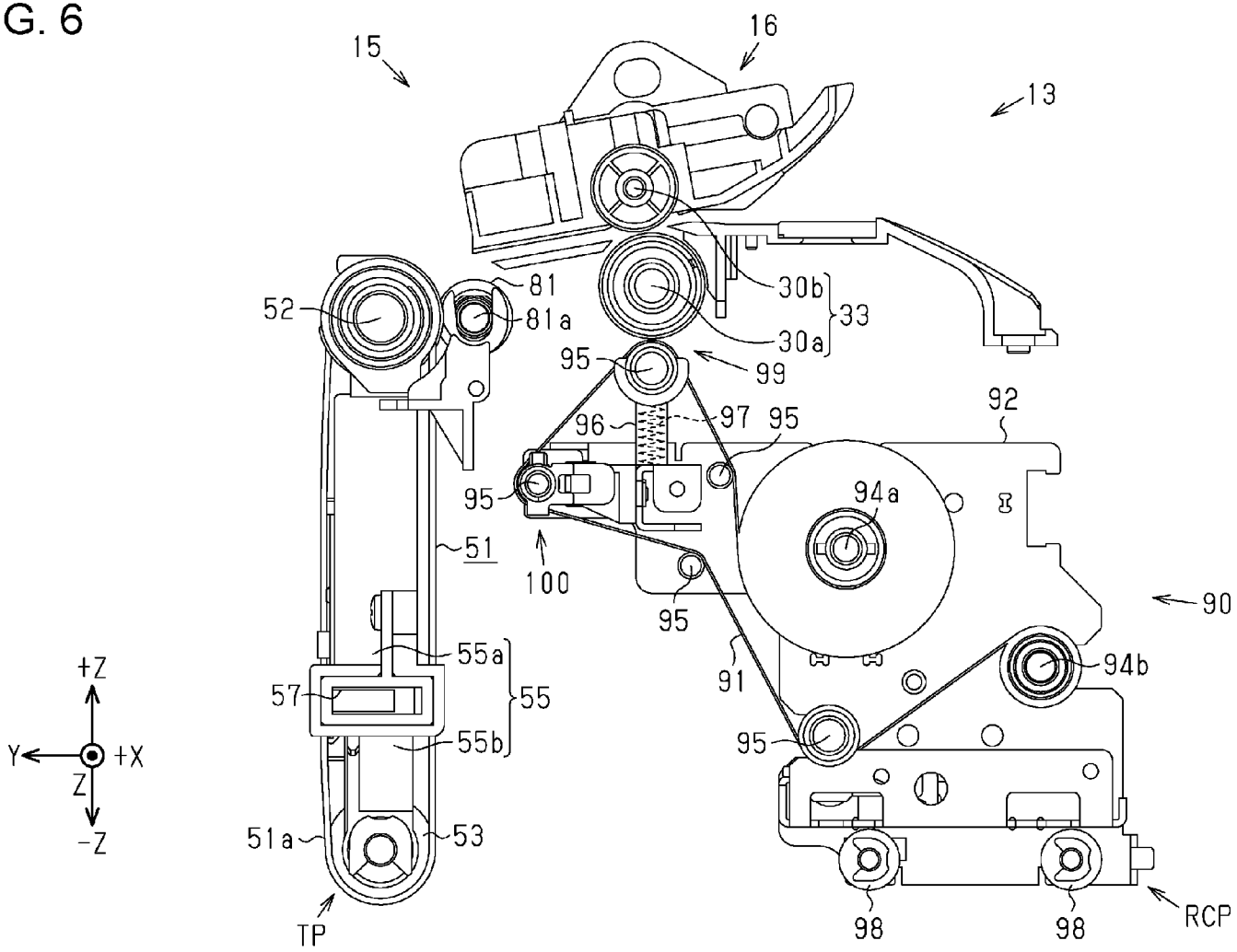
FIG. 6 is a side view that shows the cleaning unit in a case in which the transport belt is moved to the retreat position from the state in FIG. 5.

As shown in FIG. 6, when the cleaning operation of the transport belt 51 is performed by the cleaning unit 90, firstly, the transport belt 51 moves from the printing position IP to the retreat position TP by revolving (swinging) with the driving roller 52 as the center thereof. In a state in which the transport belt 51 is moved to the retreat position TP, the belt surface 51*a* of the transport belt 51 faces the belt cleaning section 100 of the cleaning unit 90. At this time, in the cleaning unit 90, a state in which the roller cleaning section 99 is in contact with the supply driving roller 30*a* is preserved.

Figure 7:
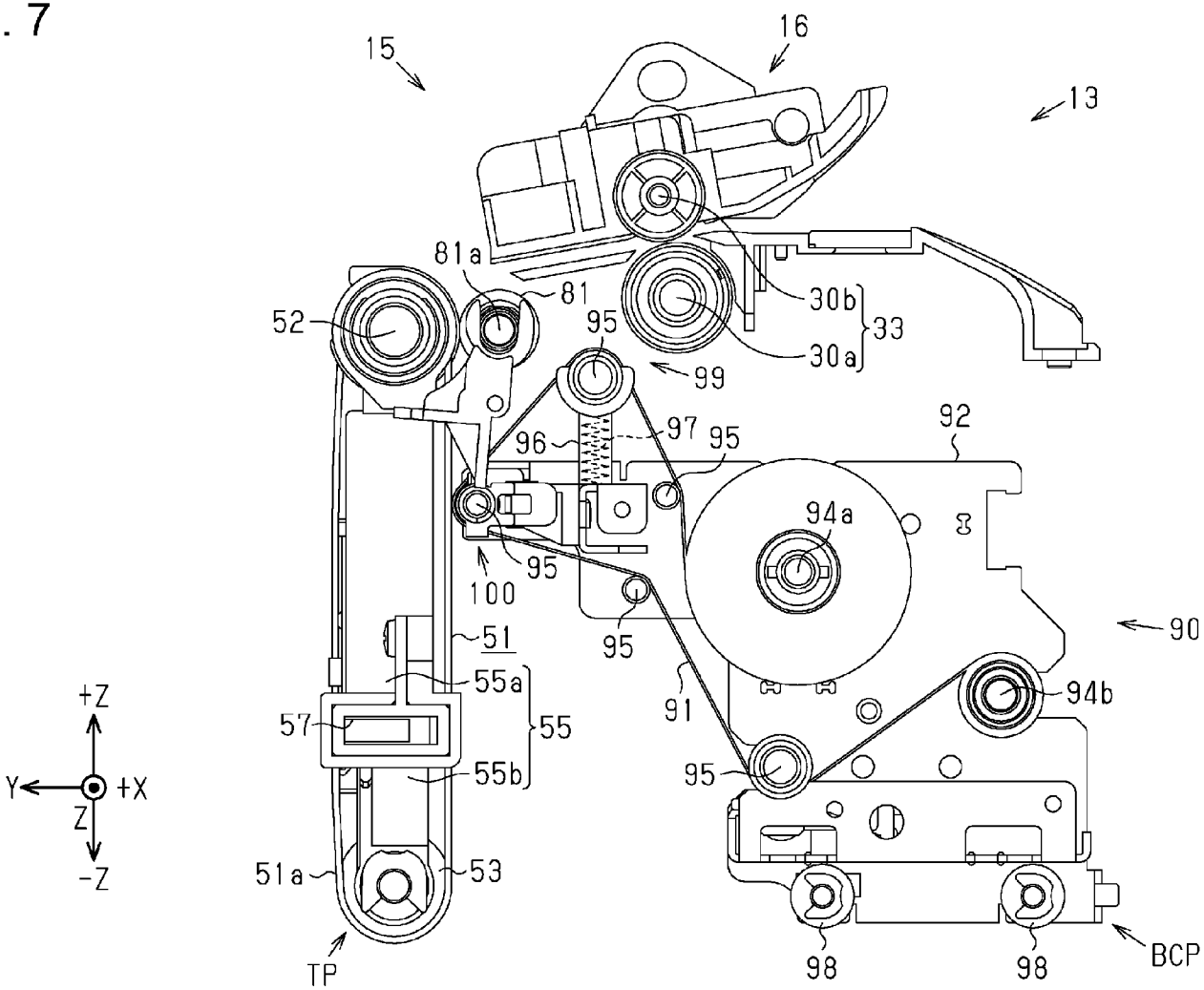
FIG. 7 is a side view that shows a state in which the cleaning unit is positioned in a belt cleaning position.

Next, as shown in FIG. 7, when the transport belt 51 is positioned in the retreat position TP, the cleaning unit 90 moves in a sliding manner from the roller cleaning position RCP to the belt cleaning position BCP as a result of rotation of the rollers 98. The belt cleaning section 100 comes into contact with the belt surface 51*a* of the transport belt 51 as a result of the movement of the cleaning unit 90 to the belt cleaning position BCP. At this time, the transport belt 51 is supported by the base body portions 55*a*, which configure the belt frame bodies 55, from a side that is opposite to a contact side on which the belt cleaning section 100 comes into contact therewith. That is, the base body portions 55*a* also function as belt support sections. Further, the cleaning unit 90 cleans the transport belt 51 as a result of the transport belt 51 rotating in circuit form in a state in which the belt cleaning section 100 is in contact therewith. At this time, the roller cleaning section 99 becomes separated from the supply driving roller 30*a* in accordance with movement of the cleaning unit 90. That is, the roller cleaning section 99 enters a non-contact state with respect to the supply driving roller 30*a* in a state in which the cleaning unit 90 is positioned in the belt cleaning position BCP.

Additionally, in the present embodiment, the cleaning member 91 is fed from the wind-out side roll core 94*a* toward the wind-up side roll core 94*b* as appropriate depending on the extent of the staining of the cleaning member 91, which is stained due to the wiping away of ink. That is, as a result of shifting the position of the cleaning member 91 in the length direction thereof, unused cleaning member 91, which is wound around the wind-out side roll core 94*a*, functions anew as the roller cleaning section 99. On the other hand, a portion of the cleaning member 91, which is used as the roller cleaning section 99, is reused as the belt cleaning section 100 as a result of being fed to a wind-up side roll core 94*b* side. Normally, it is easier for the ink, which is discharged from the printing section 18, to become attached to the transport belt 51, which is positioned more in the vicinity of the printing section 18 than the supply driving roller 30*a*. In addition, since the transport belt 51 faces the printing section 18, it is even easier for the ink to become attached thereto, and therefore, the extent of the staining is higher. Therefore, even if the roller cleaning section 99, which wipes away ink that is attached to the supply driving roller 30*a*, in which the extent of the staining is comparatively low, is reused as the belt cleaning section 100, which wipes away ink that is attached to the transport belt 51, in which the extent of the staining is comparatively high, there is not a concern that the transport belt 51 will be more stained than before the cleaning.

In summary, the cleaning unit 90 has a configuration that can clean the supply driving roller 30*a*, which configures the third pair of supply rollers 33 in the roller cleaning position RCP, and can clean the belt surface 51*a* of the transport belt 51 in the belt cleaning position BCP. That is, the single cleaning unit 90 in the present embodiment is used commonly during cleaning of the plurality of transport members 15, which include the roller member 16 and the transport belt 51.

According to the abovementioned embodiment, it is possible to obtain the following effects.

(1) In a case in which the plurality of transport members (the supply driving roller 30*a* of the third pair of supply rollers 33 and the transport belt 51 in the present embodiment) 15 that are disposed in the plurality of locations in the transport pathway 13, become stained by the ink that is discharged from the printing section 18, the single cleaning unit 90 is used commonly during cleaning of the respective transport members 15. Therefore, it is not necessary to separately provide a dedicated cleaning unit 90 for each transport member 15. Accordingly, it is possible to perform cleaning of the plurality of transport members 15 that are used in the transport of the sheets of paper 14 while suppressing an increase in the size of the apparatus.

(2) In this case, in a configuration that performs printing by discharging the ink from the printing section 18 onto the sheets of paper 14 that are transported by the plurality of transport members 15, which include the roller member (the supply driving roller 30*a* of the third pair of supply rollers 33 in the present embodiment) 16 and the transport belt 51, in a case in which the circumferential surface of the roller member 16 and the belt surface 51*a* of the transport belt 51 are stained, the single cleaning unit 90 is used commonly during cleaning of the roller member 16 and the transport belt 51. Therefore, since it is not necessary to separately provide a dedicated cleaning unit for the roller member 16 and a dedicated cleaning unit 90 for the transport belt 51, it is possible to perform cleaning of the roller member 16 and the transport belt 51 while suppressing an increase in the size of the apparatus.

(3) In a case in which the first cleaning section (the roller cleaning section) 99, which is used in the cleaning of one transport member (the supply driving roller 30*a* of the third pair of supply rollers 33 in the present embodiment) 15, is stained, since it is still possible to clean the other transport member (the transport belt 51 in the present embodiment) 15 with the second cleaning section (the belt cleaning section) 100, which is included in a different position to that of the first cleaning section 99, it is possible to suppress a concern that the staining, which is removed from the one transport member 15, will be transferred during the cleaning of the other transport member 15.

(4) As long as the cleaning member 91 is stretched between the plurality of wind-around portions 95, the first cleaning section (the roller cleaning section) 99 and the second cleaning section (the belt cleaning section) 100 are formed in separate positions in the length direction of the cleaning member 91. As a result of this, it is possible to easily configure a cleaning unit 90 that can be used commonly in the cleaning of the plurality of transport members 15.

(5) In a case in which the first cleaning section (the roller cleaning section) 99 and the second cleaning section (the belt cleaning section) 100 become stained by the cleaning of each transport member (the supply driving roller 30*a* of the third pair of supply rollers 33 and the transport belt 51 in the present embodiment) 15, as long as the cleaning member 91 is moved, it is possible to substitute the first cleaning section 99 and the second cleaning section 100 in the length direction of the cleaning member 91 with portions that are not yet stained.

(6) In a case in which the extent of the staining of the transport member (the transport belt 51 in the present embodiment) 15 that is cleaned by the second cleaning section (the belt cleaning section) 100 is higher than the extent of the staining of the transport member (the supply driving roller 30*a* of the third pair of supply rollers 33 in the present embodiment) 15 that is cleaned by the first cleaning section (the roller cleaning section) 99, it is possible to reuse the first cleaning section 99 as the second cleaning section 100.

(7) Normally, in a transport member (the transport belt 51 in the present embodiment) 15 that is disposed in a position that is close to the printing section 18 and a transport member (the supply driving roller 30*a* of the third pair of supply rollers 33 in the present embodiment) 15 that is disposed in a position that is far from the printing section 18, the extent of the staining due to the attachment of the ink that is discharged from the printing section 18 is relatively less for the transport member 15 that is disposed in a position that is far from the printing section 18 than for the transport member 15 that is disposed in a position that is close to the printing section 18. For this reason, it is possible to reuse the first cleaning section (the roller cleaning section) 99, which is used in the cleaning of the transport member 15 for which the extent of the staining is relatively low, as the second cleaning section (the belt cleaning section) 100 during cleaning of the transport member 15 for which the extent of the staining is relatively high.

(8) It is possible to switch between a state in which the first cleaning section (the roller cleaning section) 99 cleans the one transport member (the supply driving roller 30*a* of the third pair of supply rollers 33 in the present embodiment) 15, and a state in which the second cleaning section (the belt cleaning section) 100 cleans the other transport member (the transport belt 51 in the present embodiment) 15 as a result of the cleaning unit 90 being displaced between the first position (the roller cleaning position) RCP and the second position (the belt cleaning position) BCP.

(9) The cleaning unit 90 does not clean the supply driving roller 30*a* of the third pair of supply rollers 33 and the transport belt 51 simultaneously. Therefore, in comparison with a configuration that cleans simultaneously as a result of the roller cleaning section 99 and the belt cleaning section 100 respectively coming into contact with the supply driving roller 30*a* and the transport belt 51, it is possible to reduce the load when feeding the cleaning member 91 toward the roll core 94*b* from the roll core 94*a*.

(10) Since the driven roller 53 side is moved so that the distance between the rollers with respect to the driving roller 52 changes, it is possible to easily regulate the tension of the transport belt 51 by moving the rollers.

(11) Since the belt movement section 60 moves (swings) the transport belt 51 between the printing position IP and the retreat position TP as a result of rotating the driven roller 53 along a revolving trajectory with the driving roller 52 as the center thereof, for example, it is possible to easily regulate the tension of the transport belt 51 by moving the transport belt 51 to the retreat position TP in comparison with parallel movement, for example.

(12) The cleaning unit 90 is moved between the belt cleaning position BCP, in which the belt cleaning section 100 comes into contact with the belt surface 51*a*, and the roller cleaning position RCP, in which the belt cleaning section 100 is separated from the belt surface 51*a*. Therefore, in addition to removing staining of the transport belt 51, in comparison with a case of constantly being in contact, it is possible to improve the durability of the transport belt 51.

(13) Since the cleaning member 91 is brought into contact with the transport belt 51 in a case in which it is assumed that the transport belt 51 is stained, it is possible to improve the durability of the transport belt 51 in comparison with a case of constantly being in contact, while removing staining of the transport belt 51 as appropriate.

(14) Since the belt cleaning section 100 comes into contact with the transport belt 51 in a stable manner as a result of the base body portions 55*a*, which configure the belt frame bodies 55, supporting the transport belt 51 from a side that is opposite to a contact side of the belt cleaning section 100, it is possible to stably remove the staining of the transport belt 51. In addition, since a warp amount of the transport belt 51 due to the belt cleaning section 100 is suppressed by the base body portions 55*a*, it is possible to improve the durability of the transport belt 51.

Additionally, the abovementioned embodiment may be altered into separate embodiments such as those below.

In the above-mentioned embodiment, the transport members 15, which the cleaning unit 90 cleans are not limited to the combination of the supply driving roller 30*a*, which configures the third pair of supply rollers 33 and the transport belt 51. For example, the transport members 15, which the cleaning unit 90 cleans, may be the transport driving roller 48, which configures the first pair of transport rollers 41, and the transport belt 51, or may be a combination of the roller members 16 only such as a plurality of toothed rollers 49. In addition, the number of the transport members 15, which the cleaning unit 90 cleans, is not limited to two, and may be three or more. The cleaning unit 90 is a single unit that is capable of cleaning two or more transport members 15 among the plurality of transport members 15, which transport the sheets of paper 14 along the transport pathway 13.

Figure 8:
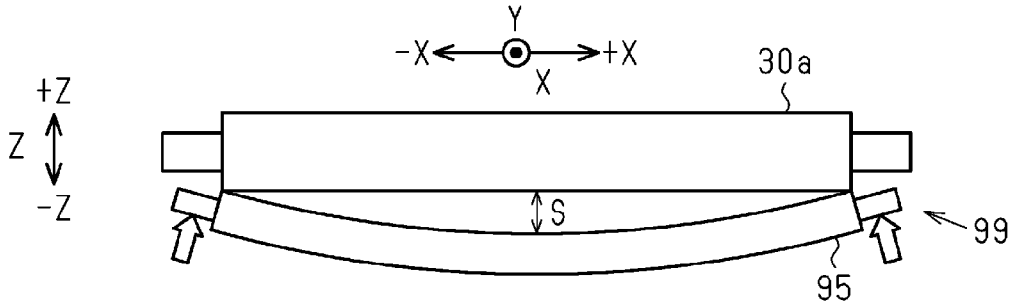
FIG. 8 is a view when a portion of the cleaning unit in the present embodiment is viewed from a downstream side in a transport direction.

As shown in FIG. 8, since the printing section 18 of the printer 11 in the present embodiment is a line head in which the width direction X is the longitudinal direction, the supply driving roller 30*a*, which configures the third pair of supply rollers 33 is also longitudinal in the width direction X. Further, the cleaning unit 90, which cleans the supply driving roller 30*a* is also longitudinal in the width direction X. Therefore, in a configuration in which only both axial ends of the first wind-around portion 95 are supported by the base frame 92, there is a concern that warping S in the vertical direction Z will arise in the intermediate portion in the width direction X of the first wind-around portion 95, and that it will not be possible to suitably clean the supply driving roller 30*a* as a result.

Figure 9:
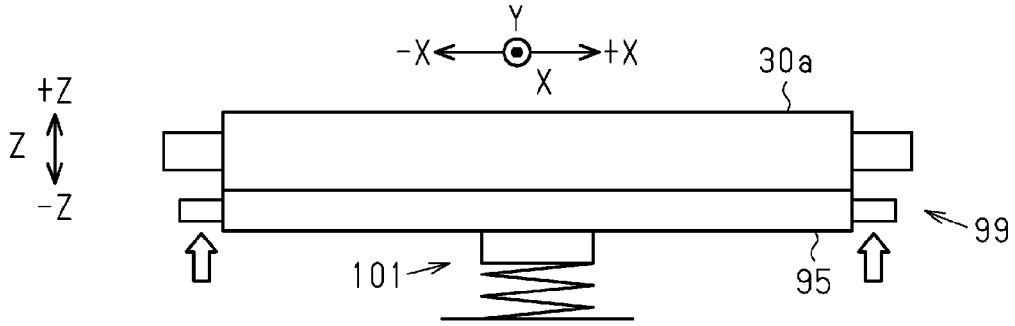
FIG. 9 is a view when a portion of the cleaning unit in a modification example is viewed from a downstream side in a transport direction.

In such an instance, in the above-mentioned embodiment, as shown in FIG. 9, as one example, a biasing member 101, which is configured by a spring, or the like, may be provided in the intermediate portion in the width direction X of the first wind-around portion 95, around which the cleaning member 91 that functions as the roller cleaning section 99 is wound. Due to the biasing member 101, such warping S is resolved due to the intermediate portion in the width direction X of the first wind-around portion 95 being biased toward the +Z side in the antigravity direction. Additionally, the same can be said for the second wind-around portion 95, which protrudes toward the downstream side in the transport direction Y.

According to this modification example, the following effect is obtained in addition to the effects of the above-mentioned embodiment.

(15) A circumstance in which the intermediate portions in the length directions of the wind-around portions 95 become warped into a state of not coming into contact with the transport members (the supply driving roller 30*a* of the third pair of supply rollers 33 and the transport belt 51 in this case) 15 due to the forces that are applied to both ends of the wind-around portions 95, is avoided as a result of biasing forces that are also applied to the intermediate portions. That is, it is possible for the cleaning member 91, which is wound around the wind-around portions 95 to clean the transport members 15 by suitably coming into contact therewith.

Figure 10:
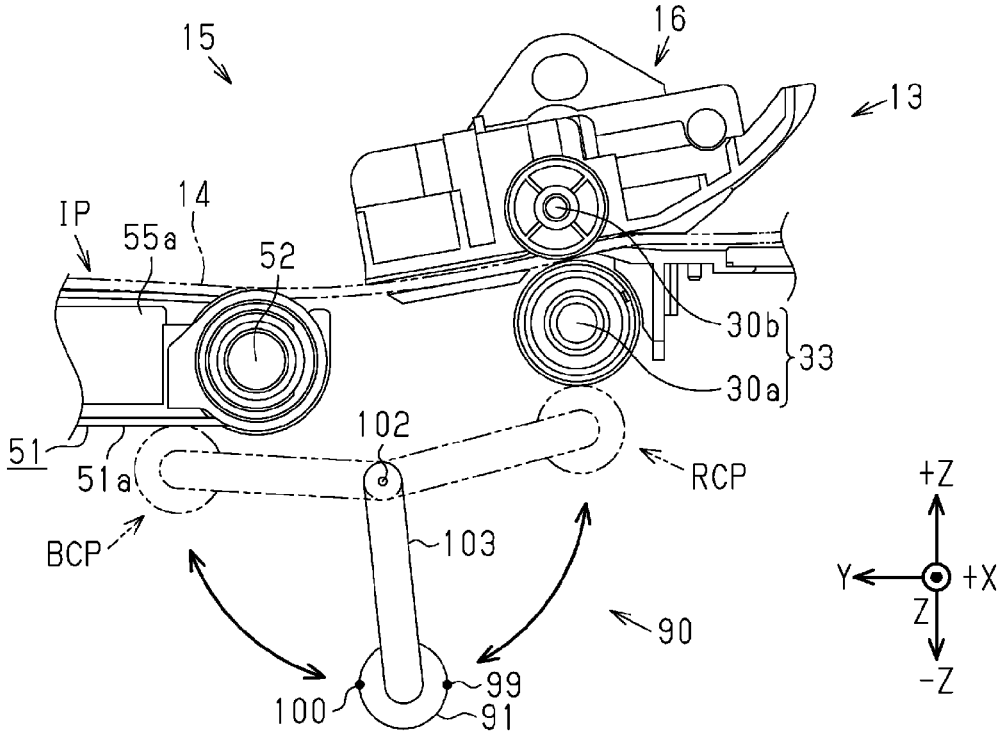
FIG. 10 is a side view that shows a modification example of the cleaning unit.

As shown in FIG. 10, in the above-mentioned embodiment, the cleaning unit 90 may have a configuration in which it is possible to clean the transport belt 51, which is positioned in the printing position IP, and for example, may be a cleaning unit 90 that moves between the roller cleaning position RCP and the belt cleaning position BCP as a result of rotating with a shaft 102 as the center thereof. Such a cleaning unit 90 is provided with an arm member 103, which is supported by the shaft 102 in a rotatable manner, and a cleaning member 91, which is provided on a side that is opposite to a side that is supported by the shaft 102 in the arm member 103. Further, the mutually different portions of the cleaning member 91 come into contact with the supply driving roller 30*a* and the transport belt 51 as a result of the cleaning unit 90 rotating with the shaft 102 as the center thereof. That is, the cleaning member 91 is provided with a roller cleaning section 99 and a belt cleaning section 100. According to this configuration, since it is not necessary to move the transport belt 51 to the retreat position TP during cleaning of the transport belt 51, it is possible to clean the plurality of transport members 15 with a more simple configuration.

As shown in FIG. 11, in the above-mentioned embodiment, the cleaning unit 90 may have a configuration in which, in the same manner as the first wind-around portion 95, an extended portion 96 and a spring 97 are also provided in the second wind-around portion 95, around which a portion of the cleaning member 91, which functions as the belt cleaning section 100, is wound. According to this configuration, since the belt cleaning section 100 is biased toward the downstream side in the transport direction Y, it is possible for the belt cleaning section 100 to come into contact with the transport belt 51 due to a suitable force.

As shown in FIG. 11, in the above-mentioned embodiment, the cleaning unit 90 is not limited to a configuration in which it is capable of moving between the roller cleaning position RCP and the belt cleaning position BCP, and for example, may have a configuration in which the roller cleaning section 99 and the belt cleaning section 100 come into contact with the supply driving roller 30*a* and the transport belt 51 simultaneously. The protruding amount of the belt cleaning section 100 in the transport direction Y of the cleaning unit 90 in FIG. 11 is greater than that of the present embodiment. According to this configuration, since it is not necessary to provide a cleaning member movement section that moves the cleaning unit 90, it is possible to set the cleaning unit 90 to have a more simple configuration.

Figure 12:
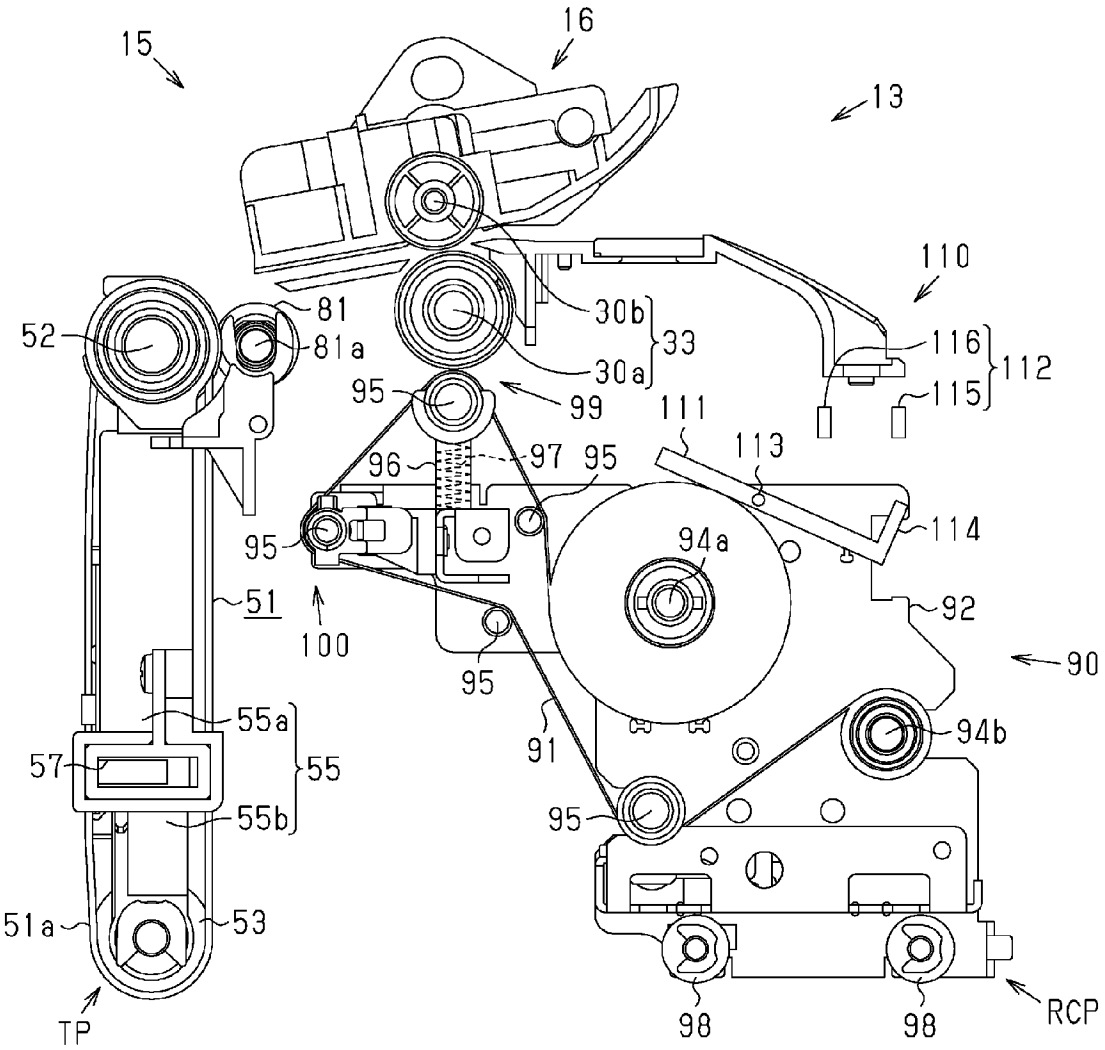
FIG. 12 is a side view that shows a cleaning unit that is provided with a residual amount detection mechanism as a modification example.
Figure 13:
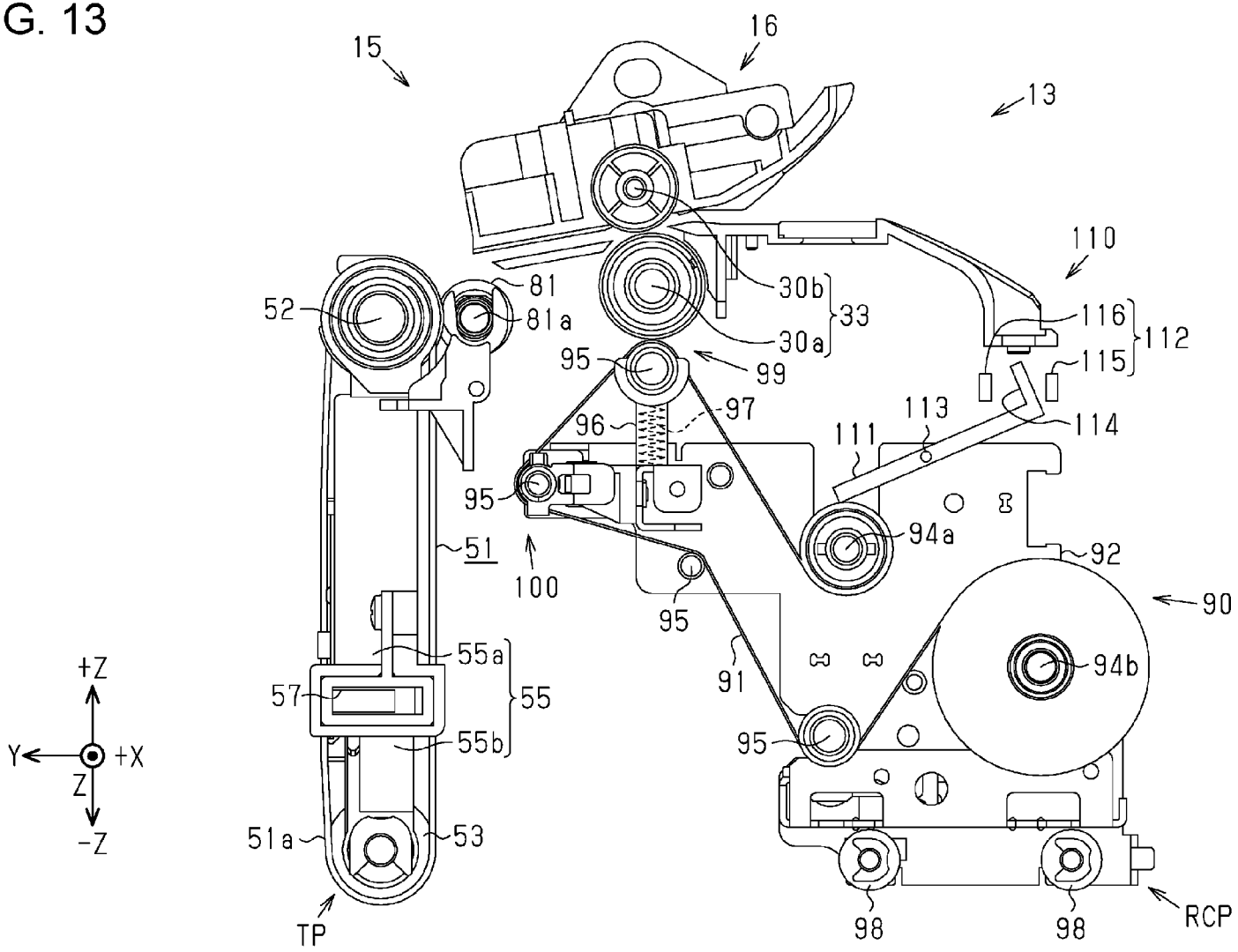
FIG. 13 is a side view that shows a cleaning unit when the residual amount detection mechanism detects a near end state.

As shown in FIGS. 12 and 13, in the above-mentioned embodiment, the cleaning unit 90 may be provided with a residual amount detection mechanism 110, which detects a residual amount of the cleaning member 91. As shown in FIG. 12, the residual amount detection mechanism 110 is provided with a flap 111, which is attached to the base frame 92, and a photointerrupter 112, which is positioned above the cleaning unit 90. The flap 111 is provided in a rotatable manner with a shaft 113, which is attached to the base frame 92, as the center thereof, and one end side, which corresponds to the downstream side in the transport direction Y is in contact with the cleaning member 91, which is wound around the wind-out side roll core 94*a*. Further, a bent portion 114, the tip end of which is bent upward, is formed on the other end side. Incidentally, the flap 111 is biased toward the anticlockwise direction in FIG. 12 with the shaft 113 as the center thereof by providing a wound spring, or the like. On the other hand, the photointerrupter 112 is configured from a light emission section 115 and a light reception section 116, which face one another, and the light reception section 116 receives emitted light from the light emission section 115.

As shown in FIG. 13, the flap 111 rotates with the shaft 113 as the center thereof on the basis of the residual amount of the cleaning member 91 in a manner in which the one end side thereof is still in contact with the cleaning member 91, which is wound around the roll core 94*a*. Further, when a state in which the residual amount of the cleaning member 91, which is wound around the wind-out side roll core 94*a*, is low, a so-called near end state, the bent portion 114 ingresses between the light emission section 115 and the light reception section 116, which face one another. As a result of the bent portion 114 ingressing, the light reception section 116 detects that the residual amount of the cleaning member 91 is low as a result of detecting a blockage of the emitted light from the light emission section 115. According to this configuration, it is possible to replace the cleaning member 91 at a suitable timing. In addition, the residual amount detection mechanism 110 is not limited to a configuration that is formed from the flap 111 and the photointerrupter 112, and for example, may be configured by a distance sensor, or the like, that measures a radius of the cleaning member 91, which is wound around the wind-out side roll core 94*a*.

In the above-mentioned embodiment, the printer 11 is not limited to a configuration in which the control section assumes that the transport belt 51 is stained on the basis of the detection results of the first sensor Sa and the second sensor Sb. For example, it may be assumed that the transport belt 51 is stained in a case in which a sheet of paper 14 that is smaller than a sheet of paper 14, which printing data that is input from an external section designates, is transported. Alternatively, it may be assumed that the transport belt 51 is stained in a case in which the printing section 18 performs a flushing process on the belt surface 51*a*, in a case in which character printing of a test pattern for discharge fault detection, correcting a discharge method of the printing section 18, or the like, is performed on the belt surface 51*a*, or the like.

In the above-mentioned embodiment, in the two rollers across which the transport belt 51 is hung, a configuration in which one roller is set as the driving roller 52 and the other roller is set as the driven roller 53, need not necessarily be used. For example, the two rollers may both be driven rollers, or may both be driving rollers.

In the above-mentioned embodiment, the transport belt 51 may be an endless form belt in that is stretch between a plurality of three or more rollers. Additionally, in this case, one roller of at least two rollers among the plurality of rollers is set as the driving roller 52 in the present embodiment, which corresponds to a swinging center of the transport belt 51, and the other roller is set as the driven roller 53, in which the belt surface 51*a*, which transports the sheets of paper 14 facing the printing section 18, is formed in the interval with the driving roller 52.

In the above-mentioned embodiment, a configuration in which tension when the printing section 18 performs printing on the sheets of paper 14 is applied to the transport belt 51 as a result of the driven roller 53 being biased so that the distance from the driving roller 52 is long, need not necessarily be used. For example, the driven roller 53 may be configured so that the tension that is applied to the transport belt 51 is regulated by changing the distance from the driving roller 52 as a result of moving the position of the driven roller 53 with respect to the driving roller 52 rather than biasing the distance from the driving roller 52 using a biasing member.

In the above-mentioned embodiment, the base body portions 55*a*, which configure the belt frame bodies 55 need not necessarily function as belt support sections, which support the transport belt 51.

In the above-mentioned embodiment, the invention is not limited to a configuration in which the cleaning unit 90 moves to the belt cleaning position BCP in a case in which the control section assumes that the transport belt 51 is stained. For example, the cleaning unit 90 may move to the belt cleaning position BCP in a case of a flushing process in the ink is discharged separately from a case in which the printing section 18 performs printing on the sheets of paper 14, a case in which printing by the printing section 18 is not performed such as a capping process, or the like, which covers the printing section 18 with the cap 71 in order to retain the discharge performance of the ink, or the like.

In the above-mentioned embodiment, the printing section 18 is not limited to a so-called line head configuration that is provided with a liquid discharging head that is capable of simultaneously discharging the ink throughout substantially the entire region of the sheets of paper 14 in the width direction X. For example, the printing section 18 may have a so-called serial head configuration in which a liquid discharging head that discharges ink is provided in a carriage, which reciprocates in the width direction X that intersects the transport direction Y of the sheets of paper 14. Additionally, in a case of a serial head configuration, a configuration in which the longitudinal direction of the printing section 18 is a movement direction of the carriage, and the sheets of paper 14, which are transported, are intermittently transported in the transport direction Y, is set.

In the above-mentioned embodiment, in the printer 11, a support table, which supports the sheets of paper 14, which are transported by the roller members 16, from the −Z side in the gravity direction, may be provided in place of the transport belt 51. In this case, a configuration in which the cleaning unit 90 is capable of cleaning a plurality of roller members 16, is used.

In the above-mentioned embodiment, the cleaning unit 90 may be provided with cleaning members 91, which are respectively separate band-shaped members for the roller cleaning section 99 and the belt cleaning section 100.

In the above-mentioned embodiment, the cleaning member 91, with which the cleaning unit 90 is provided, is not limited to a woven fabric, and may be a non-woven fabric, a sponge, or the like. In addition, the cleaning member 91 is not limited to a band-shaped member, which is wound around the roller cleaning section 99 and the belt cleaning section 100, and may be respectively independent cleaning members 91.

In the above-mentioned embodiment, the cleaning member 91 is not limited to a configuration that is only capable of moving from the wind-out side roll core 94*a* toward the wind-up side roll core 94*b*, and may have a configuration that is capable of moving in both directions including a direction from the wind-up side roll core 94*b* toward the wind-out side roll core 94*a*.

In the above-mentioned embodiment, the medium on which the printing section 18 prints is not limited to the sheets of paper 14, and another sheet form medium such as a fabric, a plastic film, or the like, may be adopted.

In the above-mentioned embodiment, the printer 11, as a printing apparatus, may be a fluid discharging apparatus that performs printing by discharging, ejecting, or the like, another fluid (including a liquid, a liquid form body in which particles of a functional material are dispersed in or mixed into a liquid, a fluid form body such as a gel, and a solid body that can be fluidified and discharged as fluid) other than ink. For example, a liquid discharging apparatus that performs printing by discharging a liquid form body including materials such as electrode materials and color materials (pixel materials), which are used in the manufacturing of liquid crystal displays, electroluminescence (EL) displays, surface-emitting displays, and the like in a dispersed or dissolved form, may be used. In addition, a fluid form body discharging apparatus that discharges a fluid form body such as a gel (for example, a physical gel), may be used. Further, it is possible to apply the present invention to any one of these fluid discharging apparatuses. Additionally, in the present specification, the term "fluid" is a concept that does not include fluids that are formed from vapors only, and for example, a fluid may include liquids (inorganic solvents, organic solvents, solutions, liquid form resins, liquid form metals (including metallic melts, and the like), liquid form bodies, fluid form bodies), and the like.

The entire disclosure of Japanese Patent Application No.: 2015-207761, filed Oct. 22, 2015 is incorporated by reference herein.

What is claimed is:

1. A printing apparatus comprising:

a printing section that performs printing by discharging a liquid onto a medium;

a plurality of transport members that are respectively disposed in a plurality of locations in a transport pathway of the medium, and that are configured to transport the medium along the transport pathway by rotating in contact with the medium, the plurality of transport members including at least an endless form belt and a roller member that separately transports the medium from the endless form belt; and a single cleaning unit that is used commonly during cleaning of the respective plurality of transport members.

2. The printing apparatus according to claim 1, wherein the roller member is configured to transport the medium by rotating causing a circumferential surface to come into contact with the medium, and the endless form belt member is disposed in a different position to that of the roller member, and that is capable of transporting the medium by rotating in a circuit form causing a belt surface to come into contact with the medium.

3. The printing apparatus according to claim 1, wherein the cleaning unit includes a first cleaning section that is configured to clean one transport member, and a second cleaning section that is configured to clean another transport member in a position that differs from that of the first cleaning section.

4. The printing apparatus according to claim 3, wherein the cleaning unit includes a band-shaped member that is stretched between a plurality of wind-around portions, and, in the band-shaped member, a portion that is wound around one wind-around portion in a length direction configures the first cleaning section, and a portion that is wound around another wind-around portion configures the second cleaning section.

5. The printing apparatus according to claim 4, wherein the cleaning unit is configured to be displaced between a first position at which cleaning of the one transport member is possible as a result of the first cleaning section of the band-shaped member coming into contact with the one transport member, and a second position at which cleaning of the other transport member is possible as a result of the second cleaning section of the band-shaped member coming into contact with the other transport member.

6. The printing apparatus according to claim 5, wherein the wind-around portions extend along a direction that is parallel to an axis of rotation of the transport members, and have a configuration in which a biasing force, which biases the wind-around portions toward the transport members, is applied to both end portions and an intermediate portion in the length direction of the wind-around portions.

7. The printing apparatus according to claim 6, wherein, among the plurality of transport members, a transport member that is cleaned by the second cleaning section is a belt member, a belt surface of which rotates in a circuit form, the belt surface coming into contact with the medium in a position that faces the printing section, and a transport member that is cleaned by the first cleaning section is a roller member, a circumferential surface of which rotates, the circumferential surface coming into contact with the medium in a position that is either further on an upstream side or a downstream side than the belt member in the transport pathway of the medium.

8. The printing apparatus according to claim 1, wherein the endless form belt is configured to displaced between a transport position at which transporting of the medium is performed, and a non-transport position at which no transporting of the medium is performed, wherein the single cleaning unit is configured to be displaced between a first position at which cleaning of the roller member is performed, and a second position at which cleaning of the endless form belt is performed, wherein when the single cleaning unit is displaced to the second position, the endless form belt is displaced to the non- transport position.

* * * * *